US011925247B2

(12) United States Patent
Siler et al.

(10) Patent No.: US 11,925,247 B2
(45) Date of Patent: Mar. 12, 2024

(54) CADDY SYSTEM FOR BARBER AND SALON SERVICES

(71) Applicants: Antonio M Siler, Akron, OH (US); Robert E Culver, II, Akron, OH (US)

(72) Inventors: Antonio M Siler, Akron, OH (US); Robert E Culver, II, Akron, OH (US)

( * ) Notice: Subject to any disclaimer, the term of this patent is extended or adjusted under 35 U.S.C. 154(b) by 397 days.

(21) Appl. No.: 17/396,658

(22) Filed: Aug. 7, 2021

(65) Prior Publication Data

US 2022/0039533 A1 Feb. 10, 2022

Related U.S. Application Data

(60) Provisional application No. 63/063,364, filed on Aug. 9, 2020.

(51) Int. Cl.

| | |
|---|---|
| ***A45D 27/22*** | (2006.01) |
| ***A45D 27/46*** | (2006.01) |
| ***A45D 44/04*** | (2006.01) |

(52) U.S. Cl.

CPC ..... *A45D 27/22* (2013.01); *A45D 27/46* (2013.01); *A45D 44/04* (2013.01)

(58) Field of Classification Search

CPC ..... A45D 27/22

See application file for complete search history.

(56) References Cited

U.S. PATENT DOCUMENTS

| | | | | |
|---|---|---|---|---|
| 3,879,787 | A * | 4/1975 | Russo | A46B 17/06 15/39 |
| 5,379,903 | A | 1/1995 | Smith | |
| 5,924,579 | A | 7/1999 | DuPont et al. | |
| 5,967,632 | A | 10/1999 | Lamia | |
| 6,095,156 | A | 8/2000 | Smith, II | |
| 6,305,388 | B1 | 10/2001 | Zeller | |
| 7,617,936 | B2 | 11/2009 | Barnett, Jr. | |
| 7,909,162 | B1 | 3/2011 | Barrett | |
| 9,516,950 | B1 | 12/2016 | Osweiler | |
| 9,669,122 | B1 * | 6/2017 | Cruz-Acosta | A45D 44/00 |
| 9,801,469 | B2 | 10/2017 | Hodge | |
| 9,814,315 | B2 | 11/2017 | Osweiler | |
| 9,949,554 | B2 | 4/2018 | Sullivan et al. | |
| 10,251,458 | B1 | 4/2019 | Weiss | |
| 10,299,569 | B1 | 5/2019 | Taylor | |
| 10,413,069 | B1 | 9/2019 | Colon | |
| 10,575,645 | B1 | 3/2020 | Colon | |
| 2008/0289983 | A1 | 11/2008 | Barnett, Jr. | |
| 2010/0217729 | A1 | 8/2010 | Takahashi | |
| 2012/0205949 | A1 | 8/2012 | Nguyen | |
| 2016/0081458 | A1 | 3/2016 | Sullivan et al. | |
| 2016/0316912 | A1 | 11/2016 | Hodge | |
| 2017/0086586 | A1 | 3/2017 | Osweiler | |
| 2017/0196342 | A1 | 7/2017 | Martin | |
| 2017/0215556 | A1 | 8/2017 | Sullivan et al. | |

* cited by examiner

*Primary Examiner* — Jason Y Ko

(74) *Attorney, Agent, or Firm* — Eric D. Jorgenson

(57) ABSTRACT

A caddy system comprising multiple stations constructed therein which enable barber tools (e.g., clippers, shavers, combs, etc.) to be placed, retrieved, for normal use, and cleaned during normal use and/or at other times. The caddy system functions can include the sanitizing and/or lubricating of barber tools when placed into the caddy. A jet nozzle system flushes the tool heads with at least sanitizing fluid. The caddy system can be so constructed to store in barber cabinets and attach to barber chairs for convenient use.

20 Claims, 12 Drawing Sheets

CADDY SYSTEM FOR BARBER AND SALON SERVICES

SUMMARY

The following presents a simplified summary in order to provide a basic understanding of some novel embodiments described herein. This summary is not an extensive overview, and it is not intended to identify key/critical elements or to delineate the scope thereof. Its sole purpose is to present some concepts in a simplified form as a prelude to the more detailed description that is presented later.

The innovative barber "caddy" is a multi-functional system employed for the convenient day-to-day usage, sanitization, cleaning, and storage of at least electric (referred to also as "clippers") and non-electric trimming and/or cutting tools (e.g., shavers). The trimming and cutting (barber/salon) tools can be utilized for cutting and trimming facial hair (e.g., mustaches, beards, ears, eyebrows, etc.) and for haircuts (e.g., hair on the scalp) as utilized at barbershops and salons, for example. The disclosed caddy system can also be used for the grooming and medical tool aspects of pets and other animals.

The caddy system can be constructed and embodied as a box or housing which includes multiple stations (also referred to as "compartments") for which clippers, shavers, combs, etc., can be placed, sanitized, and removed, as well as power cords managed. The caddy box can be of varied sizes and dimensions to accommodate internal compartments (e.g., four, six, etc.), in each compartment of which a barber/salon tool (e.g., a clipper) is received after use of trimming hair of a customer. The box can be composed of a resin material, plastic, metal alloy, and/or wood, and can incorporate an impermeable and replaceable liner or mat (e.g., plastic, rubber, etc.) that forms to the interior of the box structure.

In one implementation, the caddy box can be rectangularly constructed with a flat bottom for placement on a flat surface such as a countertop, and/or attachment to a compatible mechanism which enables utilization of the clipper box and contents from several orientations (e.g., a 45-degree angle), such as on a barber chair, and/or salon countertop in close proximity to the chair, for example. The caddy box can also be constructed of a suitable size that enables placement/storage of the box inside different cabinets and/or drawers of potentially dimensions and which are typically utilized in salons and barbershops.

The caddy box can further employ a flushing system that provides a cleaning function and/or a sanitization function for barbershop and salon tools (clippers, shavers, combs, etc.) placed into the box. For example, the handling of tools such as clippers, shavers, and razors by the barber can potentially enable the transmission of medical conditions (e.g., infections) between customers, unless addressed with a sanitization system (and procedure). Thus, the sanitization system facilitates the flushing of disinfecting and cleaning fluids over the tools to mitigate such spread of medical conditions.

Similarly, the use of grooming tools (e.g., combs, clippers, shavers, razors, etc.) by the barber can potentially accumulate particulates (e.g., hair clippings, skin cells, scales, dust, dirt, etc.) from the hair (head hair, beard, mustache, etc.) of the customer, which are desirable to be flushed from the tools before use on another customer. Thus, the flushing system facilitates the flushing of a fluid or fluids across the "working end" of the tools to remove the clippings and particulates.

The caddy box can further employ a cleaning/sanitization system (also referred collectively as the "sanitization system" or a "cleaning system") that provides a sanitization function for barbershop and salon tools (clippers, shavers, combs, etc.) placed into the box. For example, the handling of tools such as clippers, shavers, and razors by the barber can potentially enable the transmission of medical conditions (e.g., infections) between customers, unless addressed with a sanitization system (and procedure). Thus, the sanitization system facilitates the flushing of disinfecting and cleaning fluids over the tools to mitigate such spread of medical conditions.

More specifically, contact of the hair clippers (e.g., clipper handle, clipper head, etc.) with the scalp of a first client could potentially transmit a medical condition (e.g., skin condition, scalp condition, hair and scalp parasites, etc.) to one or more subsequent clients who are getting haircuts, unless the cleanliness of this client-to-client haircut process is addressed in some way. Similarly, contact of a shaver (e.g., shaver handle, shaver head, etc.) with the facial areas of a first client can potentially transmit a medical condition (e.g., skin condition, etc.) to one or more subsequent clients who are getting shaves, unless the cleanliness and sanitization of this client-to-client shaving process is addressed in some way.

The disclosed caddy box enables a sanitization (also, referred to as disinfecting) process for at least both clippers and shavers. With respect to clippers and the trimming (or cutting) head, the sanitization system contacts the trimming head components of the clipper head. In one embodiment, the sanitization system flushes a cleaning and sanitization liquid over the clipper head when resting in a station (compartment) of the caddy box. The sanitization fluid is selected to provide an optimum germ-killing function that kills germs which can be transmissible and may have been transmitted to the clipper when giving a haircut to a prior customer. The sanitization fluid can also be utilized to provide an optimum germ-killing function that kills germs which can be transmissible and may have been transmitted to the shaver when giving a shave to the facial areas of a prior customer.

In another embodiment, the cleaning (e.g., removing hair, body oils, excretions, skin, etc.) and sanitization system can comprise removable cleaning sponges positioned at the inside-bottom of the caddy box where the clipper head rests when returned to the caddy box. The sanitization system then flushes the cleaning and sanitization fluid over the clipper head when resting in a station (compartment) of the caddy box. Thus, the clipper is placed into one of the compartments with the clipper head-down to the lowest point in the caddy box.

The caddy system can employ electronic and mechanical systems operational according to programmed instructions whereby, for example, cleaning and/or sanitization function can be initiated for a single station (also referred to as a compartment of the caddy box), multiple stations, or all stations. Station cleaning can be initiated in numerous ways. For example, the replacement of a clipper into any open (unused) station can trigger either one or both of the cleaning function or/and sanitization functions of the clipper head only in that specific station. Once the specific station sanitization function has completed, an indicator (e.g., LED light that toggles between green (good to use) and red (not ready for use)) associated with that station can be enabled so the barber knows it is again available for use.

Alternatively, the sanitization system can be triggered after a predetermined number of stations have received a "used" tool (e.g., clipper, shaver, comb, etc.). For example, in a four-compartment (station) caddy box, sanitization can be automatically initiated when two of the four compartments receive tools that are now determined to be in a "used" state, in contrast to the remaining two clippers that are in an "unused" state.

Still alternatively, at least one of the cleaning or the sanitization function can be initiated when all stations detect "full" as to having a tool in each station. This detection feature can be employed using a proximity switch for each station, an optical detector, or other similar types of detection technologies commonly known in the industry.

In another embodiment, cleaning/sanitization of all stations can be initiated according to a preset time, such as every twenty minutes (as determined and set by the barber). In still another embodiment, cleaning/sanitization can also be triggered according to a time delay, such as fifteen seconds after placement of the used tool (e.g., clipper) into a station. In yet another embodiment, the cleaning/sanitization function can be initiated one hour before the barbershop/salon opens, for example.

The sanitization and cleaning functions can be initiated and controlled according to a programmed set of steps such that once the head is flushed with the fluid (e.g., hot oil), the flushing function continues for a predetermined amount of time (e.g., thirty seconds) and then stops for two minutes, for example, to enable the oil to seep (permeate) into the head to interact with all surfaces exposed to bacteria, etc., of the prior customer.

Accordingly, when including a control system into the caddy box, multiple different functions can be programmed by a given barber. Moreover, the onboard control system of the caddy boxes can each include a communications component that enables wired/wireless communications such that multiple caddy boxes can be networks (wired or wirelessly) to enable data recording of fluid data, sanitization operations, programming, self-testing, and so on. Fluid temperature can also be monitored and controlled.

The caddy system can be designed to operate with a separate accessory box that houses one or more of the subsystems and interfaces to the caddy box to facilitate execution of the desired functions. In such an implementation, the accessory box can comprise and control system that interfaces to a control system of the caddy box.

When using a clipper, for example, the caddy box can be designed such that each clipper returned to an available station actuates the sanitization system where cleaning and/or sanitization fluid (e.g., lubricating fluid such as oil, germ-killing solution, combination of both, etc.) is activated and directed (e.g., as a stationary jet stream, a cycling jet stream, etc.) over the clipper head when the clipper tool is placed into the holding station, and the fluid is flushed over the clipper head.

Alternatively, or in combination with the embodiments described herein, the sanitization system can employ ultraviolet light or other suitable light systems to kill bacteria and other undesirable medical components that otherwise would be capable of contact transmission between humans.

In another implementation of the caddy box, each station of the box employs a slot for receiving a power cord of a given clipper. Thus, when an outlet-powered clipper is used, returned to a caddy box station, and detected as being returned, the power cord drops into the station slot to provide cord management so as to reduce cord entanglement, and so on. Each station slot can be oriented (e.g., slanted, angled) as a holding area with a nonslip material (e.g., a rubber mat, mesh mat, etc.) to hold each tool (e.g., clipper) in place when seated in a station.

The caddy box can also comprise a hinged cover that closes over the top of the box, and which can be secured with a latch or lock for carrying, movement, etc., to ensure the capture and securing of all inner box components. The base of the box can also comprise a port, and a port plug that fits into the port which prevents leakage of any of the cleaning and/or sanitization fluids, if present, when moving the caddy box. Thus, the caddy box can comprise a base, the cover, and a small tube terminating as the port which enables the connection to and circulation of the sanitizer solution and cleaning fluid on and over the head areas of the barber tools placed therein.

The caddy box can be designed and implemented as a complete standalone system to include, but not be limited to, the control system, sanitization system, sanitization fluid (in a reservoir), lights, indicators, audio system (e.g., alerts, beeps, etc.), user interface to assist in programming specific functions, inputs and outputs for networking, wired and/or wireless ports, commonly-known serial communications connections (e.g., USB), power storage system to operate under charge, power plug connector for grid use and charging, and so on.

In yet another embodiment, the caddy box can be designed and implemented to include a wireless charging capability (e.g., induction). More specifically, the caddy box can include a wireless charger for each station or a single wireless charger that straddles all caddy box stations. Thus, where provided as a capability of the clippers and other charge-driven barber tools, placement of the clippers, for example, into a caddy box station will automatically initiate wireless charging of a compatible barber/salon tool. When the charge is completed, an indication on or from the caddy box can be produced (e.g., an audio tone, a light turned off or on, etc.) to alert the user that charging is complete.

In still another embodiment, sanitized head covers (e.g., clip-on) can be created and utilized for the clippers and/or shavers. The covers can be manually applied as a slip-on, clip-on, and/or magnetic-based to remain secured to the specific tool head (clipper, shaver, etc.). The head cover can be constructed to employ a sponge and/or gel inside to sanitize the tool head while the tool cover is in place on the head.

As previously indicated, and where allowed, cleaning sponges can be employed in the base of each station (e.g., located at the bottom of the caddy box where tool head rests) or one sponge for and across all stations. The sponge can be removed for cleaning and reuse of the sponges.

As yet another alternative implementation, the caddy box can also be constructed to enable add-ons. For example, the box can be constructed as a base model of four stations. Thereafter, single or double add-on stations can be purchased to attach, one-at-a time in serial fashion, to expand the base model by one or more additional stations as a need arises. The add-on stations can be built to include the hardware (e.g., rubber seals, grommets, gaskets, fasteners, ports, plugs, etc.) and electronics (e.g., connectors, indicators, ports, etc.), for indicators and coupling of oil tubes, etc.

The base of the caddy box can also be provided to magnetically couple to metal surfaces so as to minimize movement and dropping during box use. Such surfaces can be on the top of chests and work places typically provided in barbershops and salons. Moreover, the caddy box can be utilized in mechanical cooperation with barber chairs so the barber can more conveniently interact with the caddy box during normal use. This can be enabled by the use of hangers that interface to the caddy box and facilitate engagement to chairs, nearby counters, etc.

In another embodiment, the sanitization system in cooperation with the caddy hardware and/or hardware/software system can flush using the same fluid, flush using new fluid only one time, circulate the fluid within the caddy box for a given amount of uses or time, flush the fluid out of the caddy box into a remote fluid cleaning system to reuse the cleaned fluid pumped back into the caddy box, etc. The caddy box can be so designed to monitor fluid degradation (e.g., by sensors that sense fluid integrity, sense fluid cleanliness (e.g., particulates), counting the number of fluid uses, etc.) and initiate certain functions based on the determined degradation such as clean (filter), sanitize, etc.

The drive system of the disclosed barber caddy can range from a simple hand-pump mechanism to manually force fluid over the tool heads, to a grid outlet which provides continual power to an onboard caddy box power system that then pumps fluid over the tool heads, to a mechanical timer-based power system that controls power from the outlet to the caddy based on a preset mechanical timer setting, to an onboard control system programmed to control power to the caddy based on programmed settings, to a battery backed storage system that is charged and delivers power to the caddy with outlet power is removed, and so on.

The barber caddy system can also comprise reservoirs for fluid storage (clean and/or dirty). For example, in a compact implementation, the sanitization system can access a first reservoir which contains lubricant and a second reservoir that contains sanitizing fluid. Alternatively, in another implementation, the product container in which the lubricant is purchased can be mechanically interfaced directly to the caddy box, where the lubricant is then pumped from the container when needed. Similarly, the product container in which the sanitizing fluid is purchased can be mechanically interfaced directly to the caddy box, where the sanitizing fluid is then pumped from the container when needed.

In a robust implementation, the product container for sanitizing fluid can be a dual-compartment container with a filter. In operation, the sanitizing fluid container is mechanically interfaced to the caddy system where the new sanitizer is pulled (pumped) from the clean-fluid compartment of the container, flushed over the tool heads, returned to the container into the dirty (or used) compartment of the container, eventually to reprocessed as cleaned, and then reused. When the useful life of the sanitizer is reached, the entire container can be discarded and recycled. Additionally, it can be the case where the dual-compartment container can be processed to filter and then re-use the now cleaned sanitizer fluid. This process can also be applied to a dual-compartment container purchased for the lubricant.

Put another way, a caddy system is disclosed, comprising: a housing for receiving barber tools related to haircuts and shaving; one of multiple stations positioned in the housing and into which a barber tool is placed; and a sanitization system activated to at least one of lubricate or sanitize the barber tool while in the station.

The sanitization system flushes a tool head of the tool with lubricant and sanitizing fluids. The system can further comprise a pad (or mat) compatible with and for optional use with each of the stations and on which the barber tool is placed.

The system can further comprise one or more jets from which at least one of a lubricating fluid or sanitizing fluid are projected onto the barber tool head. The system can further comprise a drain internal to the housing and into which the at least one of the lubricating fluid or sanitizing fluid drain. The system can further comprise a drain port and port plug that enable removal of at least one of the lubricating fluid or sanitizing fluid via a drain. The system can further comprise a pumping system that forces at least one of the lubricating fluid or sanitizing fluid onto the barber tool head.

The system can further comprise a control system that operates a pump to push at least one of the lubricating fluid or sanitizing fluid onto a tool head of the barber tool. The system can further comprise a button and an indicator that enable manual operation of the barber caddy system via the button and operation state via the indicator. The system can further comprise a power system that provides power to electrical and mechanical components. The system can further comprise an induction charging system that charges barber and/or salon tools.

The system can further comprise a power cord management system that mitigates cord entanglement when using multiple corded barber tools. The system can further comprise a magnetic base for coupling to a magnetically compatible surface. The system can further comprise a control system that enables programmed operations to be performed in association with the stations of the housing. The sanitization system employs light that when directed at a tool is sufficiently destructive to kill germs. The system can further comprise a clip-on sanitization head that attaches to the tool head to enable sanitization of the tool head. The system can further comprise a reservoir from and through which sanitizing fluid is pumped and filtered.

In yet other embodiments, a caddy system for grooming tools is disclosed, the caddy system comprising: a housing for receiving a grooming tool related to at least one of giving a haircut or a shave; multiple stations constructed into the housing and into which a station the grooming tool can be placed; and a flushing system for at least one of forcing a fluid into contact with the grooming tool while the grooming tool rests in the station.

The station can further comprise a slot which enables cord management when multiple tools are placed in the caddy system. The caddy system can further comprise an interior sloped surface having an upper edge, the sloped surface interior to the sides of the housing, and a lower edge that forms a sloped drain. The caddy system can further comprise a mesh drain overlay which lies over the drain and catches larger material flushed from the grooming tool during a flushing process.

The caddy system can further comprise a drain plug in the housing that facilitates removal of the fluid from the housing. The caddy system can further comprise a pumping system that pumps and recycles the fluid into contact with the grooming tool. The fluid can be at least one of a cleaning fluid for flushing particulates from the tool, lubricating fluid for lubricating any moving parts of the grooming tool(s), or a sanitization fluid for disinfecting the grooming tool.

The caddy system can further comprise an individual mat for each of the stations and on which mat the corresponding grooming tool rests. The caddy system can further comprise a nozzle system, the nozzle system comprising jet nozzles that enable pressurized spray of the fluid onto a head of a grooming tool during a flushing process. The caddy system can further accommodate a hand razor that employs a clip-on head guard which retains sanitizing fluid in a sanitizing material of the guard while the guard is captured on a razor head of a grooming tool.

In yet another embodiment, a caddy system for grooming tools is disclosed, the caddy system comprising: a rectangular housing into which are constructed multiple stations for receiving grooming tools related to at least cutting hair; an interior sloped surface constructed within the housing and having an upper edge and a lower edge, the lower edge forms a sloped drain which collects fluid flushed over a part of each grooming tool placed into a station; and a flushing system mounted internal to the housing for directing a fluid into contact with the grooming tool while the grooming tool rests in a corresponding station.

Each of the multiple stations further comprises a slot constructed in a side of the housing which enables placement of a power cord, as cord management, when multiple tools are placed in the caddy system. The caddy system can further comprise a replaceable mat which rests on an upper surface of the sloped surface, and upon which can be placed a grooming tool. The fluid has a disinfecting property which sanitizes a part of the grooming tool. The caddy system can further comprise a storage area embodied in the housing in which grooming tools can be placed. The caddy system can further comprise a nozzle system, the nozzle system comprising jet nozzles that enable pressurized spray of the fluid onto a head of a grooming tool during a flushing process.

In still another embodiment, a caddy system for grooming tools is disclosed, the caddy system comprising: a rectangular housing into which are constructed multiple stations for receiving grooming tools related to at least cutting hair, wherein each of the multiple stations further comprises a slot constructed in a side of the housing which enables cord management when multiple tools are placed in the caddy system; an interior sloped surface constructed within the housing and having an upper edge and a lower edge, the lower edge forms a sloped drain which collects fluid flushed over a part of each grooming tool placed into a station; a replaceable material which rests on an upper surface of the sloped surface, and upon which can be placed a grooming tool; and a flushing system mounted internal to the housing for directing a fluid into contact with the grooming tool while the grooming tool rests in a corresponding station.

The fluid can have at least one of a disinfecting property which disinfects a part of the grooming tool or a lubricating property which to lubricates moving parts of the grooming tool. The flushing system can include a nozzle system, the nozzle system comprising jet nozzles that enable pressurized spray of the fluid onto a portion of a grooming tool during a flushing process. The jet nozzles can be adjusted to disperse the fluid over a predetermined area of the grooming tool.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION

The disclosed innovative "caddy" (also referred to as the "barber caddy") is a multi-functional system constructed into a housing (also referred to the caddy box) and employed for the convenient day-to-day usage, sanitization, lubrication, storage, and retrieval of grooming tools (e.g., electric and non-electric trimming and/or cutting barber tools) for barbershops and salons.

It is to be understood that when referring to the caddy as a barber caddy, the disclosed description and features find applicability for tools and items utilized at salons. The phrase "grooming tools" is defined to include electric and non-electric cutters and clippers, snips, blowers, trimmers, combs, brushes, tweezers, shavers, razors, scissors, hot irons, and essentially any tool that can be used to facilitate the grooming of a human and/or animal of body hair, nails, and teeth (e.g., tooth brushes, tooth picks, floss), for example.

Thus, the barber (grooming) tools include electric tools such as electric clippers (for scalp hair) and electric shavers (for cutting and trimming facial hair such as mustaches, beards, ears, eyebrows, etc.), and non-electric tools such as manual (hand) trimmers (e.g., scissors) and razors utilized for cutting and trimming facial hair (e.g., mustaches, beards, ears, eyebrows, etc.), combs, and other tools as typically utilized at barbershops and salons, for example.

It is to be understood that any of the grooming tools (electric and non-electric tools) can be used for cutting, trimming, combing, styling, etc. For example, a scissors (a non-electric tool) can be used to cut scalp and facial hair and the clippers (an electric tool) can be used to trim scalp and facial hair. The disclosed caddy system can also be used for the grooming of pets and other animals.

The barber caddy can be embodied as a box which includes multiple stations (also referred to as "compartments") for which clippers, tweezers, shavers, scissors, combs, etc., can be placed, sanitized, and removed, as well as power cords managed. The box can be of varied sizes and dimensions to accommodate multiple internal stations (e.g., four, six, etc.) of which a barber clipper is received after use of trimming hair of a customer. The box can be composed of a resin material, plastic, metal alloy, and/or wood, and can incorporate an impermeable and replaceable liner (e.g., plastic, rubber, etc.) that forms to the interior of the box structure.

Figure 1:
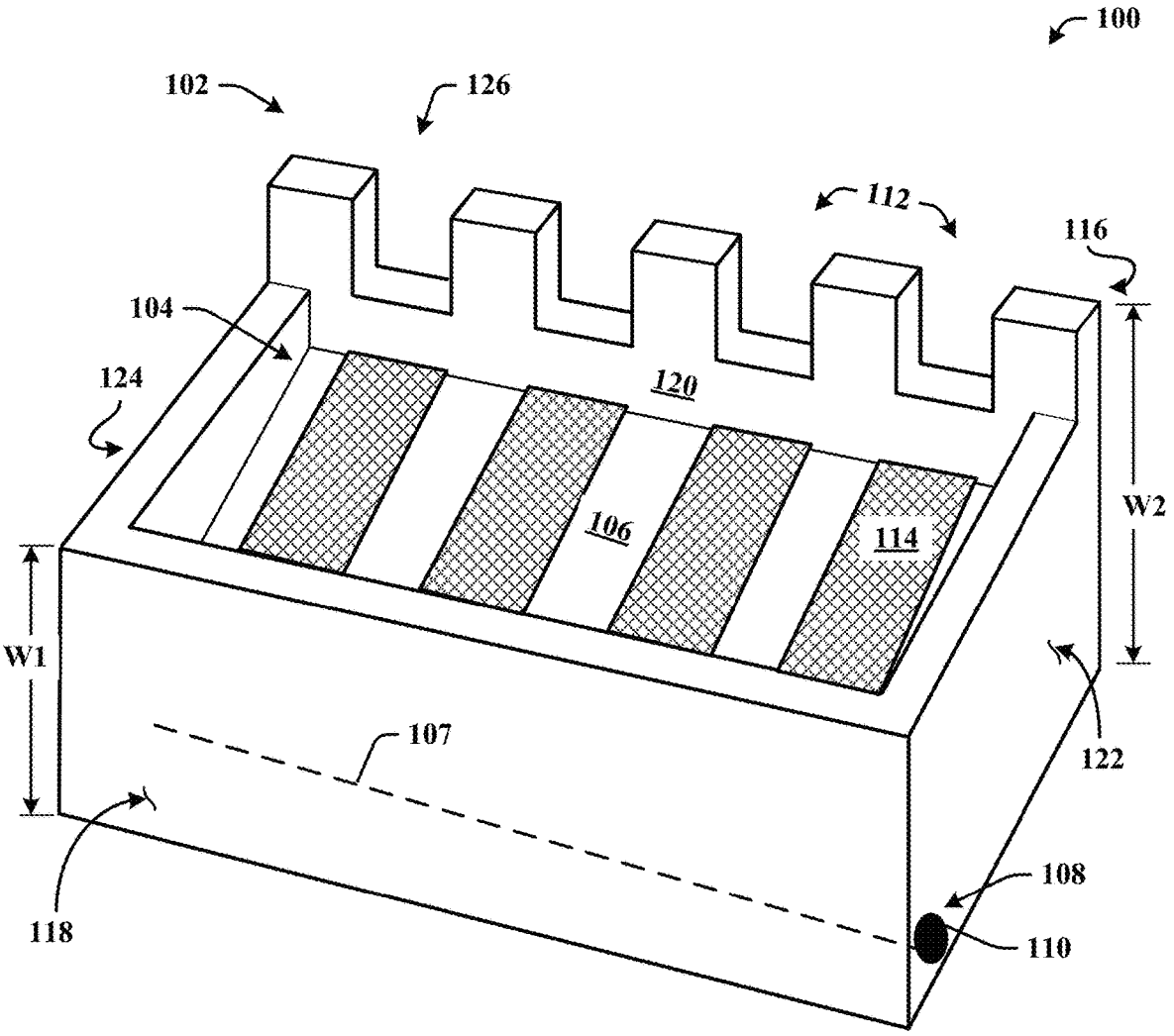
FIG. 1 illustrates an isometric view of a barber caddy system in accordance with the disclosed architecture.

FIG. 1 illustrates an isometric view of a caddy system 100 (e.g., for barbers, salons, personal use, etc.) in accordance with the disclosed architecture. The caddy system 100 is constructed as a multi-station system (e.g., four stations), where each station 102 includes the structure and features to accommodate at least an electric clipper (a cordless or corded barber and/or salon tool). To that end, an interior 104 of the caddy system 100 incorporates a sloped surface 106 (e.g., the plane of the surface 106 facing upward and downward, and sloping downward from back to front of the interior 104) for ease of access in taking and returning the associated barber tool in the interior 104.

The sloped surface 106 also facilitates the use of fluids used as part of the sanitization and/or lubrication processes and which drain downward on the sloped surface 106 to the lowest part of the interior 104 of the caddy system 100, and thereafter, into a sloped drain 107 (depicted as a dashed line as looking through the front face of the caddy housing and that slopes either left-to-right or right-to-left depending on the location of a drain hole 108) that directs the fluids to the drain hole 108 (covered by a drain plug 110). The drain plug 110 can be a threaded plug that is turned into the drain hole. Alternatively, the plug 110 can be a push plug that is pushed and pulled from the drain hole 108.

In this embodiment, the drain hole 108 and drain plug 110 are provided on a first short side 122, which first short side 122 is opposite a second short side 124. In this embodiment of the barber caddy system 100, the width (W1) of the other long side 118 is less than the width (W2) of the first long side 116.

To maintain a placed clipper (not shown) in a desired orientation and thereby enabling the ease to again retrieve the clipper from a station 102, each station 102 further includes one or more slots 112 (e.g., a power cord guide) to assist in preventing cord entanglement in other stations and associated tools when multiple corded clippers are used, and a mat (or pad) 114 on which to place the clipper to elevate the clipper off the sloped surface 106 (for ease of grasping and cleanliness) and to mitigate slippage of the clipper to a less desired orientation. Additionally, the mat(s) 114 can be removed for cleaning. The mat(s) 114 can also be designed with a non-skid side which interfaces to the sloped surface 106 to mitigate tool slippage while the barber tools are being taken from the caddy and returned to the caddy. The mat(s) 114 can be temporarily affixed or permanently affixed to the sloped surface 106.

As shown, the upper edge of the sloped surface 106 can terminate below the lower edge (see label 204 of FIG. 2) of the slots 112. Alternatively, the upper edge of the sloped surface 106 can terminate at the lower edge of the slots 112. Still alternatively, the sloped surface 106 can instead comprise multiple different (first and second) sloped surfaces wherein a first sloped surface associated with two stations includes a first upper edge which terminates below the lower slot edge, and a second sloped surface associated with two other stations includes a second upper edge which terminates at the lower edge of the associated slots.

In another implementation, the mat(s) 114 do not extend to the upper edge of the sloped surface 106, but only extend a portion up the sloped surface (e.g., half the distance, etc.), since the cleaning and sanitization fluid can be restricted to the head portion of the barber tool, which is proximate the lower edge (not viewable) of the sloped surface 106. Since cordless and/or corded barber tools can be utilized in the caddy, the tools can be of varied dimensions such as length. Accordingly, the mats 114 can be of correspondingly varied lengths as well.

The mats 114 can be made from any of one or more types of material, designs, and dimensions, such as a webbed plastic weave, magnetic material such that the grooming tool is magnetically coupled to the sloped surface which is metallic, a solid non-slip material, a soft non-slip material, rubber, and so on. Additionally, the mat(s) can be multiple smaller pieces, one per station, one per two stations, and/or a single mat for all four stations, etc. Moreover, the mat(s) can be sufficiently long so that the upper edge of each mat or the mat rises above the lower edge of each slot and/or lays within the cord guides (e.g., see FIG. 2).

In one implementation, the caddy system 100 is constructed as a rectangular housing (or box) with slots 112 along the top of a first long side 116 and the sloped drain 107 along the other (opposite) long side 118 and near the bottom of the other long side 118 in the interior 104. The sloped surface 106 is entirely in the interior 104 and slants downward from an upper part 120 of the first long side 116 to a lower part of the other long side 118. Although depicted as substantially rectangular, it is within contemplation of the disclosed innovation that a curved construction can be employed that provides some or all of the disclosed features, yet may be more appealing to some users.

In one implementation, the caddy box can be rectangularly constructed with a flat bottom for placement on a flat surface such as a countertop, and/or attachment to a compatible mechanism which enables utilization of the caddy box and contents from several orientations (e.g., a 45-degree angle), such as on a barber chair, and/or salon countertop in close proximity to the chair, for example. The caddy box can also be constructed of a suitable size that enables placement/storage of the box inside different drawer dimensions typically utilized in salons and barbershops. The caddy box can also employ a non-slip bottom so that when the box is placed on a surface (e.g., a countertop), the box will not easily slide around when contacted.

Figure 2:
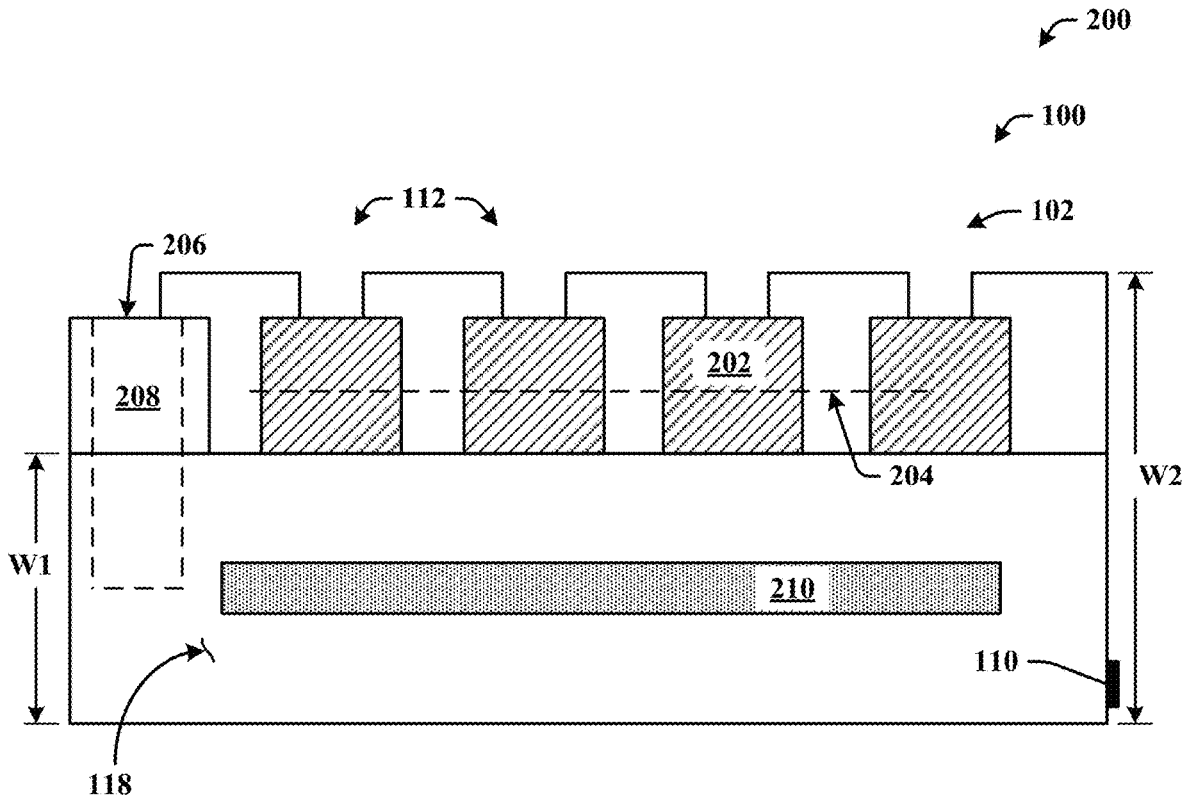
FIG. 2 illustrates a view of the barber caddy system of FIG. 1 with alternative mat placement.

FIG. 2 illustrates a view 200 of the barber caddy system 100 of FIG. 1 with alternative mat placement. As shown, the barber caddy system 100 comprises the other (or opposite or second) long side 118, the drain plug 110, and multiple cord guides 112 for the multiple stations 102. In this embodiment, the placement of the mats 202 can be placed higher (or of greater length) than shown in the caddy system 100 of FIG. 1, as indicated here by a dashed line 204 which represents the lowest edge of the station cord guides 112 (also referred to as slots).

A storage area 206 is also provided in which tool parts, combs, tweezers, brushes, etc., can be stored and yet made easily accessible during client service. The storage area 206 can include a cavity (or well) 208 of sufficient dimensions (external height, internal depth, and inside/outside width) sized to hold the desired tools of the trade. The storage area 206 can also include a storage cover (not shown) that when opened enables access to the cavity 208 and items stored therein. The cover can be a hinged cover, for example. The storage area 206 can also be designed as a removable piece that once removed (e.g., lifted upward and out), enables access to underlying internal components, ports, areas, and subsystems for maintenance of the caddy system 100. The cavity 208 can be employed to hold some amount of liquids to some level so that inserting of items into the upright orientation of the storage cavity 208 facilitates submersion to some extent of portions of the items placed therein.

In another implementation, a storage area 210 can be employed as part of the long side 118. This can be a pull-out drawer into which items can be placed and easily picked and removed during client servicing. For example, when the drawer is pulled out, a comb can be placed in the drawer until needed again. When closing business for the day, and the drawer is closed, the caddy 100 can operate to spray sanitizer/cleanser on any items laid in the closed drawer in order to prepare these items for a next use. The fluids can be circulated back over the items as programmed by the user. The storage area 210 can also be designed as a rocker drawer where the drawer, when opened, pivots hingedly outward to expose the opening of the drawer for placement of tools, and other items.

Alternatively, any time the drawer is closed, the cleaning and sanitization process is automatically initiated and run for a specific amount of time. The process can continue or terminate based on one or more sensors employed that when sensing process parameters (e.g., temperature, fluid cleanliness/dirtiness (e.g., particulation), fluid chemical changes, time elapsed, timer setting, time of day, etc.) effects the process in the desired way (e.g., terminate, continue, etc.).

Figure 3:
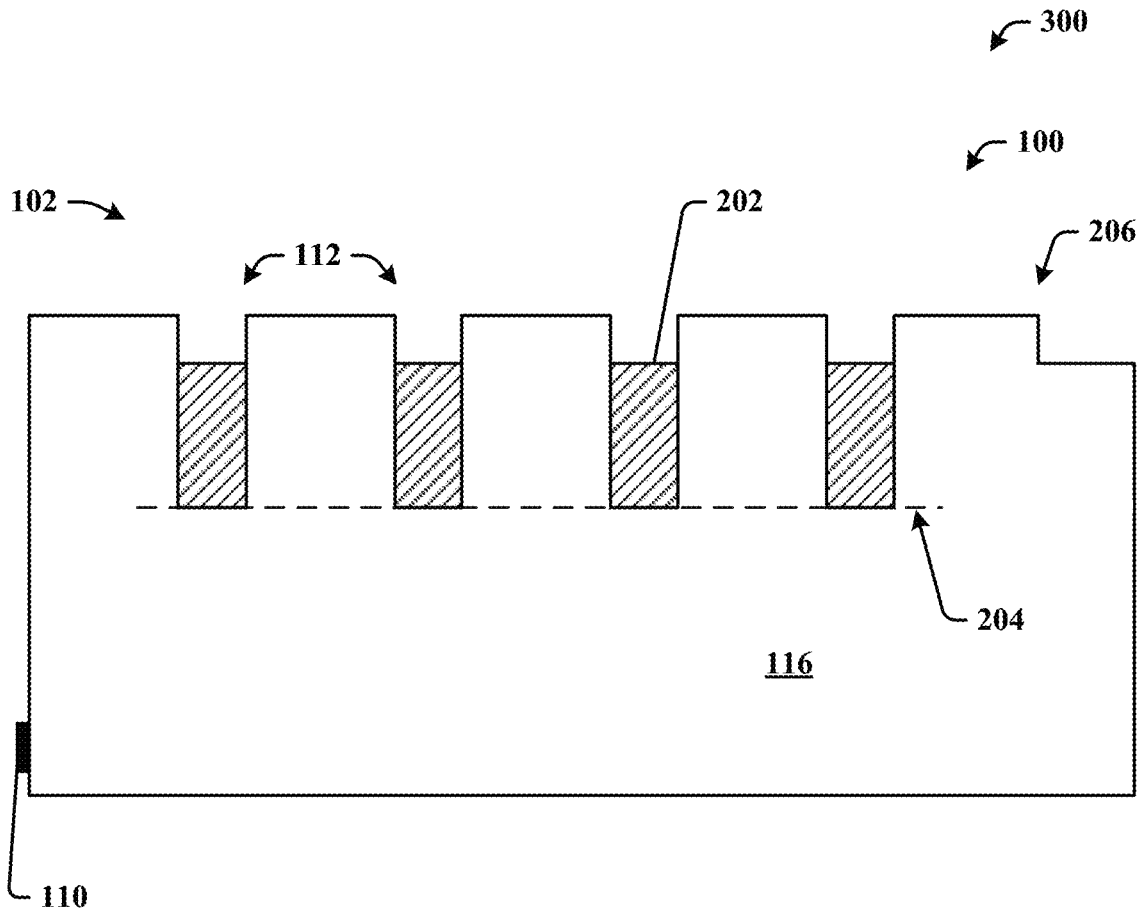
FIG. 3 illustrates another view of the barber caddy system of FIG. 1 with the alternative mat placement.

FIG. 3 illustrates a view 300 of the barber caddy system 100 of FIG. 1 with alternative mat placement. As shown, the barber caddy system 100 comprises the first long side 116, the drain plug 110, and multiple cord guides 112 for the multiple stations 102.

In this embodiment, the view 300 shows the placement of the mats 202 relative to the dashed line 204 which represents the lowest horizontal inside edge of the station cord guides 112. An access cover (not shown) can enable access to the internal components for maintenance of the caddy system 100.

The mat(s) 202 can be individual items, one for each station (or slot), or a single large mat employed for all stations 102. The mat(s) 102 can be permanently or temporarily attached to the sloped surface 106.

Figure 4:
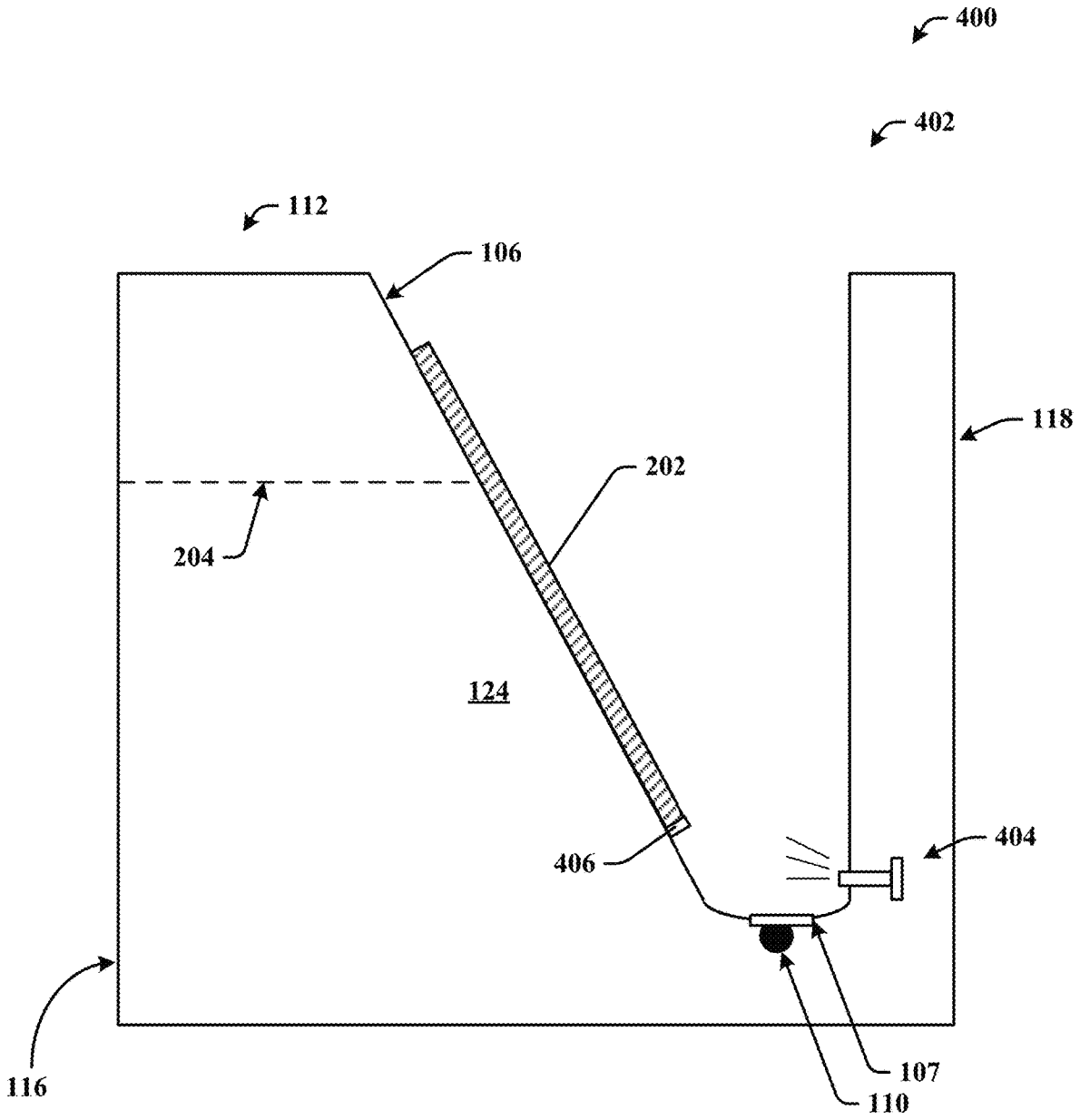
FIG. 4 illustrates a cross-sectional view of a barber caddy system that employs a jet nozzle system.

FIG. 4 illustrates a cross-sectional view 400 of a barber caddy system 402 that employs a jet nozzle system 404. (The first short side 122 and a portion of the opposite second short side 124, are not shown.) As shown, the barber caddy system 402 comprises the first long side 116, the drain plug 110, and multiple cord guides 112 (not readily viewable) for the multiple stations 102. However, in this embodiment, the first long side 116 and the other long side 118 are the same width (W1=W2, as shown in FIG. 2), although this is not a requirement for usage of the barber caddy systems shown and described herein.

In this embodiment, the placement of the mats 202 can be higher on the sloped surface 106 than the mat(s) 114 of shown in FIG. 1, as indicated here by the dashed line 204 which represents the lowest edge of the station cord guides 112. Additionally, in this implementation, the sloped surface 106 extends near to or to the top of the cord guides 112, rather than terminating below the cord guides 112 as shown in FIG. 1.

The jet nozzle system 404 can be embedded near the inside bottom and above the sloped drain 107 that collects and directs expended sanitization fluid and/or lubricant fluid for disposal and/or further processing (e.g., separation, cleaning, etc.). In another embodiment, the collected sanitization fluid and/or the lubricant fluid can be routed back to the pump through a filter and then reused (pumped out the jet nozzle onto the barber tool heads resting in the station(s) 102). The jet nozzle 404 can be adjusted (e.g., turned) so that the nozzle output spray is dispersed to cover a wide area of the tool heads. The jet nozzle 404 can be adjusted to output a small spray mist (cloud) that covers the tool heads, yet remains at or near the bottom of the caddy system 402. There can be a single jet nozzle for each station, a single jet nozzle for two stations, and so on, depending on the dispersion setting of the nozzles.

In this embodiment, the drain hole 108, drain plug 110, and low end of the sloped drain 107 are shown as designed in the opposite short side of the implementation of FIG. 1. It is also to be understood that the caddy system 100 (and system 400, for example) can be oriented in any way the user desires. For example, side 118 can be used as the front-facing side. Alternatively, side 116 can be used as the front-facing side.

Thus, the user can position the caddy system 100 (and/or accessory unit) to conveniently remove from and replace to the barber and/or salon tools according to side 116 or according to side 118. Electrical and/or charging cords (e.g., USB) can extend out of a work console drawer into which the caddy system 100 can be stored.

The cleaning and/or disinfectant solution can comprise an oil and water solution, heated or otherwise, for example. Other compositions can be employed as approved and sufficient to function as a cleaning solution, and/or as a disinfecting solution for the desired purposes.

The caddy system 100 can be designed to employ convenient and safe techniques for replacing solutions. For example, side 118 can be made removable or detachable for disassembly and cleaning, and storage purposes.

The mats 202 (similar to mat 114) can be sponge or mesh material, that spatially separates the tool head the thickness of the underlying mat from the solution below. The jet nozzles 404 spray onto the clipper head area, where clipper heads are placed into the caddy system 100 such that the clipper heads are proximate the sloped drain 107. The nozzles 404 can be made and installed to be directional to direct spray where desired for each tool head (e.g., clipper head). The output ports of the nozzles 404 can alternatively be made rectangular for a more side-to-side spray distribution. Still alternatively, each of the nozzle ports can be designed such that the output port sprays the fluid in a left and right butterfly pattern (the fully open wing pattern of a butterfly) to engulf two or more adjacent clipper heads simultaneously. Other output port designs can be employed as well such as left-right and up-down spray distributions. Mat 202 can rest on small ledge 406 designed into the sloped surface 106, or be magnetic coupled to the sloped surface 106.

Figure 5:
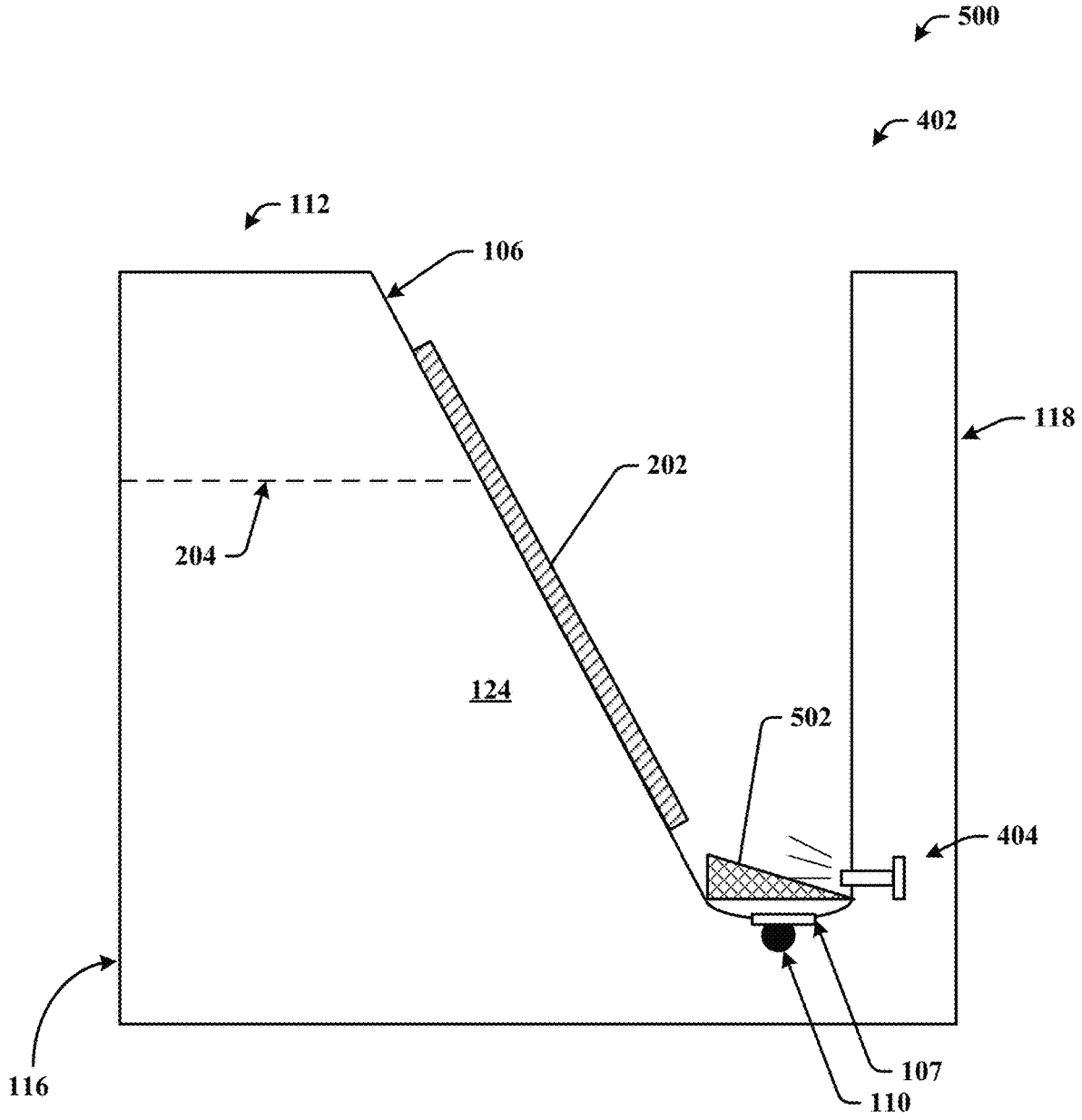
FIG. 5 illustrates a cross-sectional view of the barber caddy system that employs the jet nozzle system and a mesh drain cover.

FIG. 5 illustrates a cross-sectional view 500 of the barber caddy system 402 that employs the jet nozzle system 404 and a mesh drain overlay 502 that lies over the drain area. The mesh drain overlay 502 can be used to catch larger material and then cleaned for reuse above the sloped drain 107. The mesh drain overlay 502 is so designed to not obstruct the nozzle output, yet provide a softer resting place for the tool heads. The mesh drain overlay 502 can extend the length of the interior of the housing and on top of the sloped drain 107.

Figure 6:
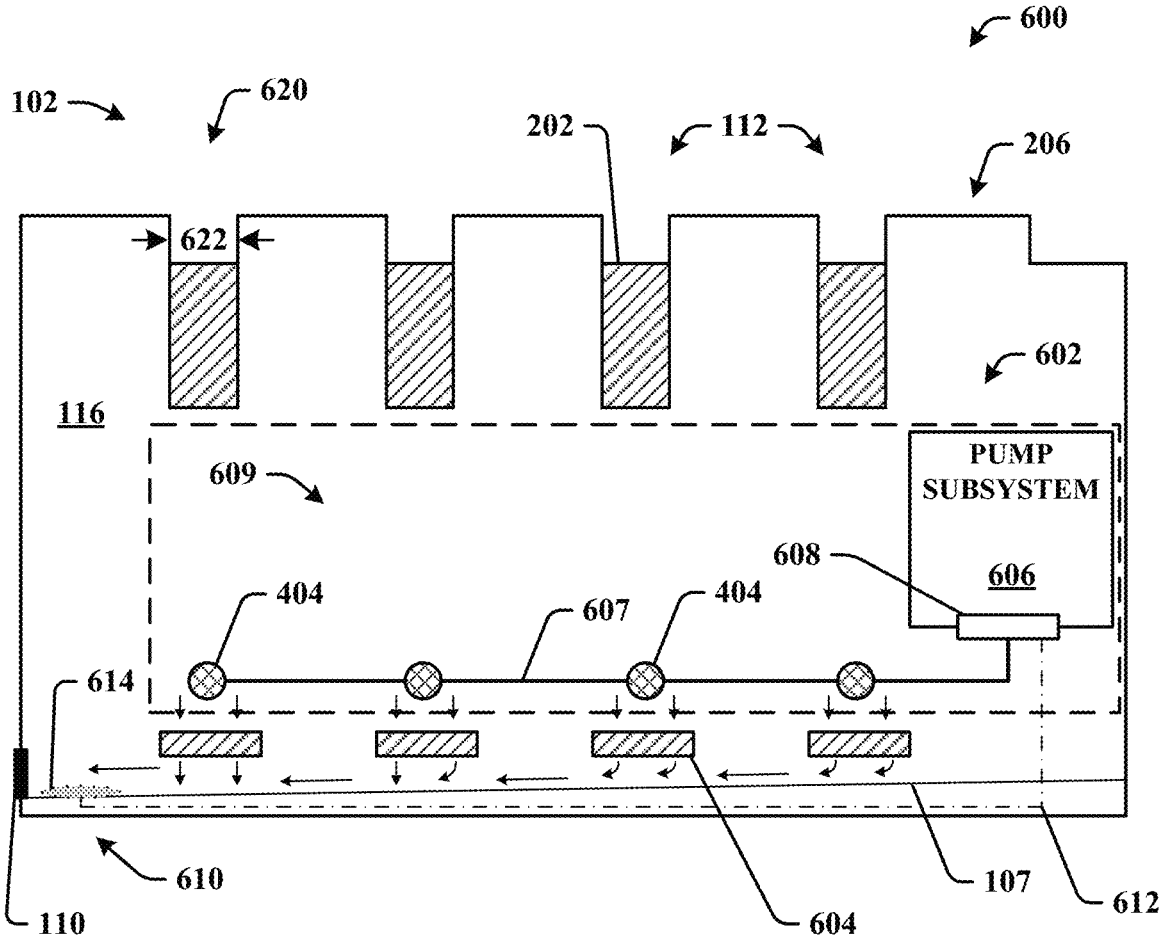
FIG. 6 illustrates a view of the caddy system further showing an internal pumping system for the sanitization system.

FIG. 6 illustrates a view 600 of the caddy system 100 further showing an internal pumping system 602 for the pumping fluid for the sanitization process (and cleaning). This view 600 shows that each of the stations 102 includes a dedicated jet nozzle 404, and a separate mat 202 the bottom end of which is represented as bottom end 604.

The caddy system 100 can include a pump subsystem 606 from which fluid is forced through tubing 607 to nozzles 404 resulting in pressure-spray directed from the associated jet nozzles 404 and onto a tool head (not shown) in the given station (of the stations 102). The fluid then drains from the sanitized tool (e.g., head) downward and through (represented by the arrows) the associated mats 202 and into the sloped drain 107.

The pump subsystem 606 includes an interface connection 608 that connects the jet nozzles 404 and interconnecting tubing 607 (the combination referred to herein as a nozzle subsystem 609) to the pressure-output of the pump subsystem 606. The interface connection 608 can be a suitable hardware connection interface that enables the pump subsystem 606 to be disconnected from a nozzle subsystem 609 and removed for maintenance. The pump subsystem 606 can be adjusted (e.g., manually, programmatically, etc.) to increase or decrease pressure of the fluid pushed to the nozzles 404. Thus, a higher pressure can provide a more powerful cleaning and sanitization process when desired for adjustment by the user. This capability can also be controlled and adjusted by the user via a software interface that enable such control over functions of the barber caddy system. It is also within contemplation of the disclosed caddy system that a design can enable each nozzle output to be controlled individually, such that a first nozzle has a greater pressure output than a second nozzle output.

Similarly, the nozzle subsystem 609 can be accessed and/or removed and serviced (e.g., cleaned, adjusted, apply replacement parts, etc.). For example, each nozzle 404 can be accessed by a user to adjust the directional output of the cleaning liquid. For example, a nozzle head can include an output port that simply enables a circular spray output of the sanitization fluid onto a barber tool head.

In another implementation, the nozzle head can be constructed as a flatter output port where the sanitization fluid is sprayed in a more rectangular output such that one nozzle 404 can provide overlapping fluid spray coverage with an adjacent nozzle 404 of an adjacent barber tool head of an adjacent station.

As depicted in FIG. 6, the nozzle distribution along the interconnecting tubing 607 can comprise a single nozzle per station. That is, each barber tool station 102 is associated with a corresponding nozzle is aligned on a vertical axis centered vertically in the cord guide. More specifically, an end station 620 (where an "end station" is defined as located at the right end or the left end of the row of cord guide stations 112) has a cord guide gap 622 through or into which a tool power cord or other tool feature extends. The cord guide gap 622 has a generally rectangular dimension where the gap 622 defines the width and centrally located vertical axis aligned in the center of the gap 622.

Alternatively, or in combination with the above-mentioned nozzle implementation, a single nozzle can be located between two barber tool stations and spray sanitizing fluid on two tool heads (one to the immediate left of the nozzle and one to the immediate right of the same nozzle) with the more rectangular sanitization output (e.g., spray, liquid spout, etc.) that covers left and right areas. The sloped surface 106 can also be cleaned and sanitized manually once the mat(s) are removed.

The sanitizing subsystem (also called disinfecting subsystem) can be configured to use a warm to hot cleaner, enabled when the desired temperature is reached. The cleaning function of the subsystem can utilize a filter to filter out hair and other debris picked up by the barber and salon tools during serving of the customers (e.g., clipping, combing, snipping, shaving, trimming, etc.).

The solution can be changed every predetermined amount of time (e.g., every two weeks). This changing function can be performed manually and/or automatically (e.g., automated based on a timer). Alternatively, or in combination with other functions/features, a sensor (e.g., optical) can be employed to periodically or continually sense clarity (or opacity) as a measure of cleanliness or lack thereof of the solution (or fluid).

Figure 7:
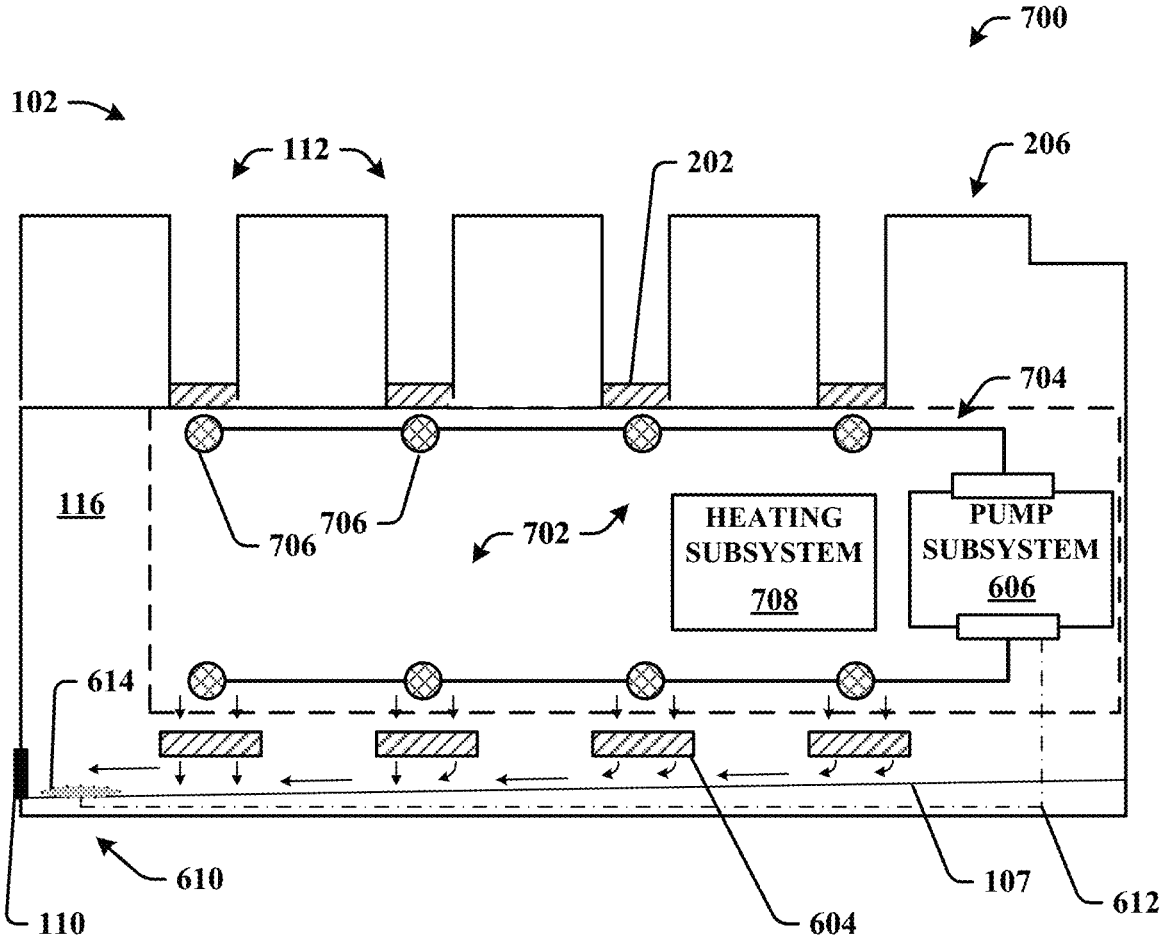
FIG. 7 illustrates a sanitization head for the head of a barber tool.

FIG. 7 illustrates a caddy 700 that employs a dual sanitizing/cleaning nozzle system 702. In a more robust and automated implementation, the sloped surface 106 can be flushed from the top of the sloped surface 106 downward by implementing a second nozzle subsystem 704 internal to the housing and in support of flushing fluid (e.g., heated) from associated nozzles 706 just below the lower edge of the slots 112 so that fluid (sanitizing and/or cleaning) for flushing the sloped surface 106 is forced out and down the sloped surface 106 for a predetermined amount of time (and temperature). Nozzles for this second nozzle subsystem 704 can also be provided to direct fluid forward, left, and right to substantially cover all points of the sloped surface 106.

In one embodiment, the "used" fluid drains to the lowest part 610 of the sloped drain 107, and thereafter, can be removed from the caddy system by removing the plug 110 and allowing the used fluid to be drained and discarded (e.g., recycled).

In an alternative embodiment, the fluid collected in the lowest part 610 of the drain can be recycled back through the pumping system 606, filtered, heated, and re-used through the jet nozzles 404 for additional sanitization purposes of the stations 102. In other words, in this embodiment, the pumping system 606 can further include a return pipe 612 (shown as a dash-dot line) that is used to pump (pull) the collected fluid 614 from the lowest part 610 of the sloped drain 107 back into the pumping system 606 to be filtered for particulates, etc., and reused (through the jet nozzles 404). In such an embodiment, the integrity (e.g., cleanliness) of the sanitization fluid can be tested using onboard sensor(s), for example, to ensure that reused fluid meets a minimum integrity metric for reuse.

A heating subsystem 708 can be employed to heat the fluid to a programmed temperature before pumping the fluid out the nozzle distribution system to flush the desired areas of the caddy 700, such as the sloped area 106, the tool heads, the mats 202, etc. Alternatively, the heating subsystem 708 can be employed solely to heat the fluid to a temperature that ensures all organisms in the fluid are killed. Thereafter, the heating subsystem 708 can be programmatically controlled to reduce the fluid temperature for suitable touching and handling of the caddy 700 and assorted features.

Figure 8:
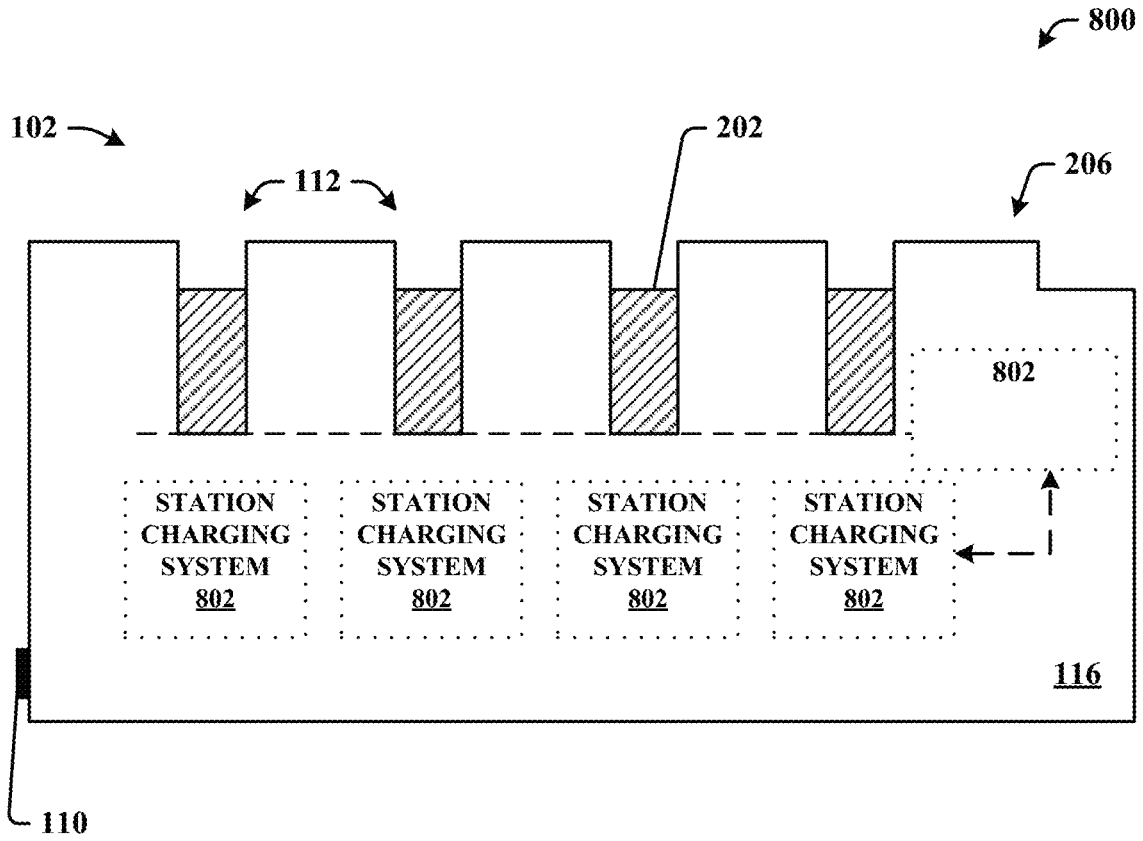
FIG. 8 illustrates a modular barber caddy system where one or more modular stations can be added to a base system.

FIG. 8 illustrates the implementation of a charging subsystem 802 in a caddy system 800. The charging system 800 enables induction charging of compatible induction charging barber tools (e.g., hair clippers) placed into one or more of the stations 102. In support thereof, shown are four station charging systems 802, one for each of four caddy stations, to enable induction charging for those barber tools that enable such charging. Corded barber tools can still use the station, since induction charging will not affect the power system of the corded tool. Thus, the caddy system 800 can support corded and non-corded powered barber tools. It is also to be understood that a corded barber tool can also employ induction charging when placed in the station 102 and not powered by grid voltage.

It is to be appreciated that while not shown, the caddy system 800 can further employ a power strip (e.g., 120 VAC) in the caddy housing such that corded devices (e.g., barber tools) can be plugged into the power strip for use, rather than utilizing wall plugs for power.

Figure 9:
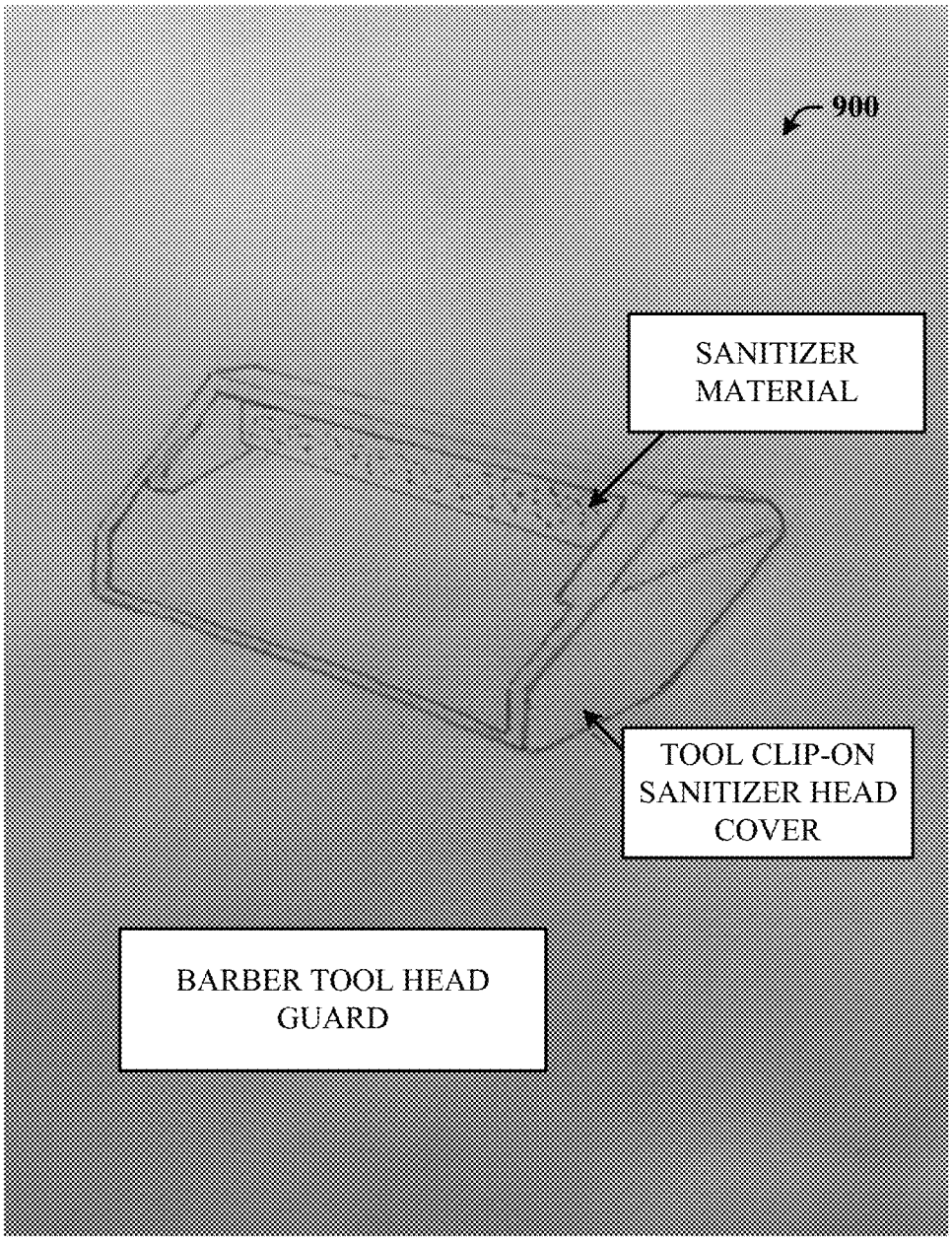
FIG. 9 illustrates a sanitization head guard for the head of a barber tool.

FIG. 9 illustrates a sanitization head guard 900 for the head of a barber tool. The head guard 900 can be employed as a clip-on mechanism for electric and non-electric shavers, clippers, etc. The head guard 900 can also serve as a guard that prevents/mitigates injury to the user from inadvertent contact with a potentially sharp edge of the barber tool. The head guard 900 can also include a sanitizing material embedded therein that contacts the cutting edge and portions proximate to the cutting edge to sanitize a part of the tool head when engaged on the tool.

Figure 10:
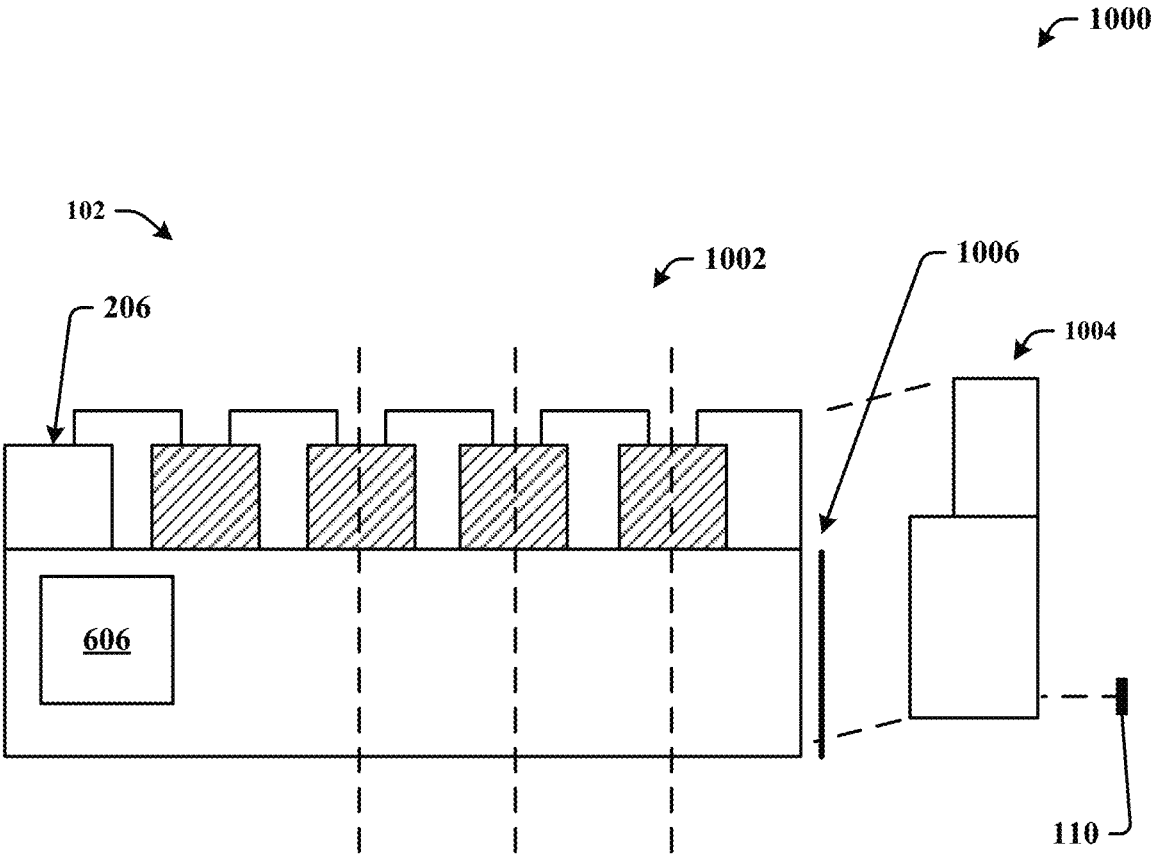
FIG. 10 illustrates a modular barber caddy system where one or more modular stations can be added to a base system.

FIG. 10 illustrates a modular barber caddy system 1000 where one or more modular stations can be added to a base system. For example, the modular barber caddy system 1000 can be designed as a base unit 1002 of four stations 102. Thereafter, the user may determine the need for one or more additional stations. Accordingly, a modular add-on station 1004 can be affixed to the base unit 1002 such that a gasket 1006 enables an established non-leak interface between the add-on 1004 and the base unit 1002. The add-on 1004 is then fully functional with a jet nozzle, drain, mat, and so on. The modular caddy system 1000 then comprises five functional stations.

In such a modular system, the sloped drain, drain plug, can be designed into the housing in the reverse such that the drain port 108 and drain plug 110 are proximate the pumping subsystem 606, rather than the opposite end of the housing, where the add-on 1004 is connected.

As used in this description, the terms "component" and "system" are intended to refer to a computer-related entity, either hardware, a combination of software and tangible hardware, software, or software in execution. For example, a component can be, but is not limited to, tangible components such as a microprocessor, chip memory, mass storage devices (e.g., optical drives, solid state drives, and/or magnetic storage media drives), and computers, and for software components such as a process running on a microprocessor, an object, an executable, a data structure (stored in a volatile or a non-volatile storage medium), a module, a thread of execution, and/or a program.

By way of illustration, both an executing application can be a component. One or more components can reside within a process and/or thread of execution, and a component can be localized on one computer and/or distributed between two or more computers.

Figure 11:
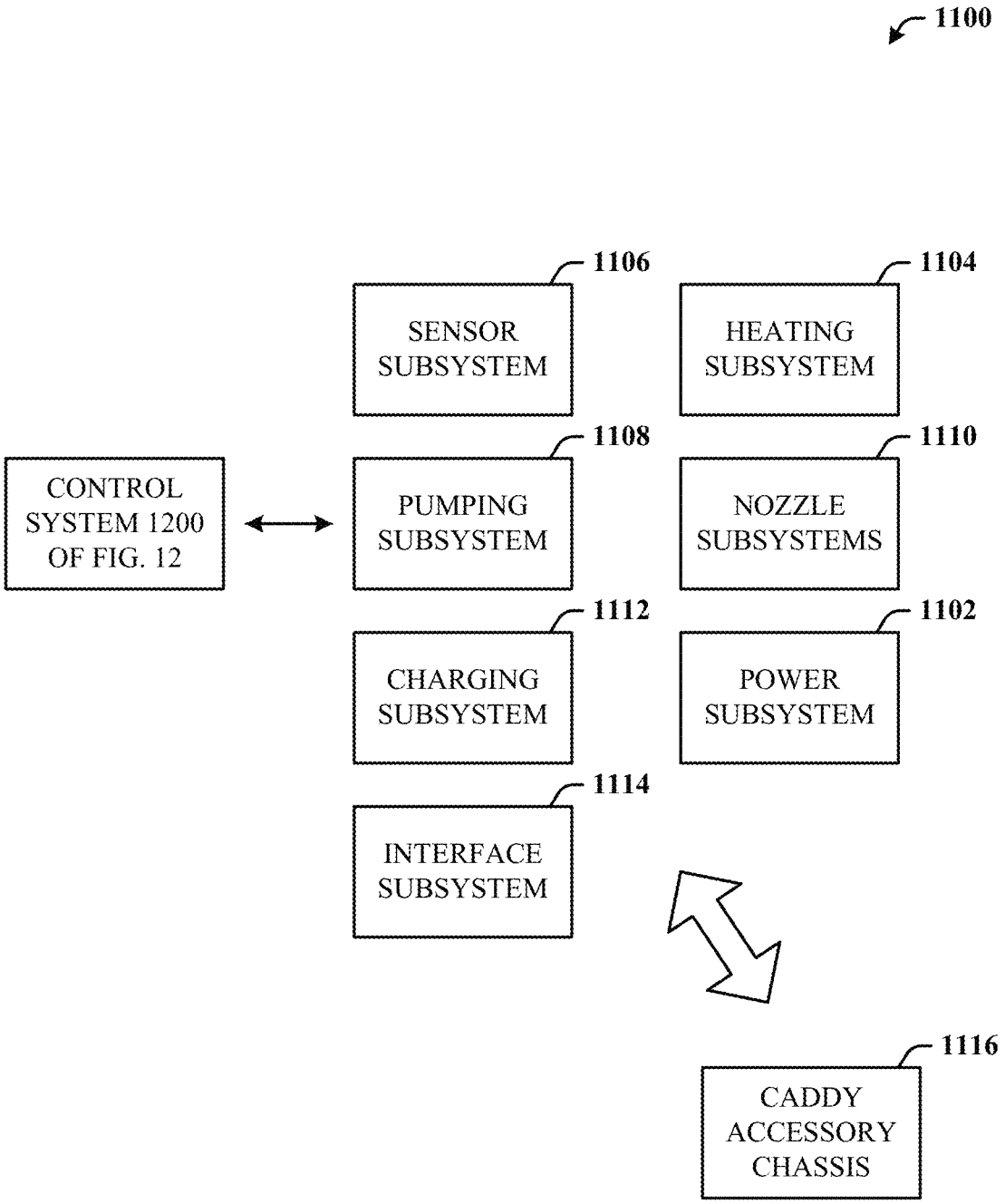
FIG. 11 illustrates one or more subsystems that can be employed in the barber caddy in accordance with the disclosed architecture.

Referring now to FIG. 11, there is illustrated a block diagram of subsystems 1100 that can be employed in the barber caddy 100 in accordance with the disclosed architecture. It is to be appreciated that one or more of the disclosed subsystems 1100 can be utilized for enhanced caddy processes and user conveniences.

For example, a power subsystem 1102 can be employed in the caddy system 100 or an accessory chassis to provide power (e.g., 120 VAC, DC voltages (e.g., 12 volt, 5 volts, etc.)) to the caddy system 100 and all onboard subsystems as needed. The power subsystem 1102 also comprises any outlets and connections employed for the caddy system 100, such as powered USB (universal serial bus), for example, and grid power.

A heating subsystem 1104 (similar to heating subsystem 708) can be provided to enable programmed heating of the fluid for specific purposes. For example, the fluid can be heated to or above a specific temperature to kill organisms introduced into the fluid via flushing tool heads, etc. The fluid can be heated to or above a different temperature to enable fluid flow for pumping, spraying, flushing, sanitization, and cleaning purposes.

A sensor subsystem 1106 can be employed as one or more sensors to facilitate temperature control, charging control, power control, fluid flow control, fluid pressure control, timers, process control for specific processes during work hours or after hours, timer control, interface sensing with an accessory system and other items, for example.

A pumping subsystem 1108 (similar to pumping subsystem 606) enables achieving a programmed pressure and distributing fluid to nozzle subsystems 1110 (similar to nozzle subsystems 609 and 702) for dispersion over tool parts and caddy sections for cleaning and sanitization.

A charging subsystem 1112 enables to use of induction charging subsystems 802, the charging of onboard battery systems, and so on.

Interface subsystem 1114 enables all hardware and/or software interfaces of the caddy system 100 and accessory systems that can be employed.

It is also to be understood that any one or more of the subsystems (1102, 1104, 1106, 1108, 1110, 1112, 1114) and system 1200 (of FIG. 12) can be employed external to the caddy 100 in a separate caddy accessory system 1116 that can accompany the caddy system 100 and/or in a separate chassis. For example, the pumping subsystem 1108 can be housed in the separate accessory chassis 1116, as well as the charging subsystem 1112 and pumping subsystem 1108.

As previously indicated, where contagious diseases (e.g., COVID19. etc.) are spreading, combs and other barber/salon tools may need to be completely submerged as part of a disinfecting and cleaning process. Such submersion capability can be provided on the caddy system 100 in the (substantially vertical) holding area 206 (in cavity 208) and/or on a separate cleaning/disinfectant submersion accessory system.

The separate (coverable) system can interface (e.g., attach to the back of the caddy system 100), and into which is a cleaning/disinfecting solution and barber/salon tools (e.g., combs) can be placed and submerged. A timer can be employed to track the desired disinfecting and/or cleaning time duration.

Alternatively, or in combination therewith, the cleaning/disinfecting capability can be provided in a horizontal fashion such as in front drawer and/or tray that hangs off the front-facing edge of the caddy system 100, or attaches to the front-facing side of the caddy system 100 using commonly known techniques (e.g., magnetics, hanger hooks, Velcro™, buttons, hooks, clasps, etc.) and into which combs and other tools can be placed for disinfecting and cleaning. Still further, these drawer/tray capabilities can be employed in or on either or both short sides of the caddy system and/or accessory chassis.

Figure 12:
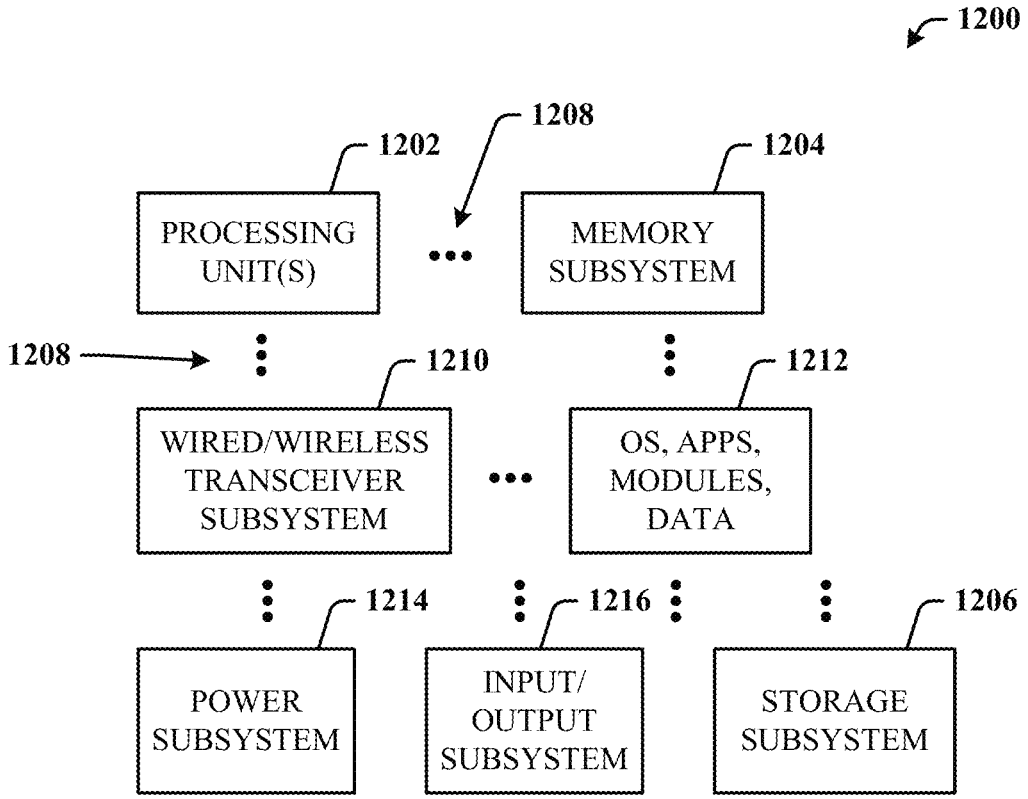
FIG. 12 illustrates a block diagram of a control system that can be employed in the barber caddy in accordance with the disclosed architecture.

Referring now to FIG. 12, there is illustrated a block diagram of a control system 1200 that can be employed in the barber caddy in accordance with the disclosed architecture. It is appreciated, however, that the some or all aspects of the disclosed methods and/or systems can be implemented as a system-on-a-chip, where analog, digital, mixed signals, and other functions are fabricated on a single chip substrate.

In order to provide additional context for various aspects thereof, FIG. 12 and the following description are intended to provide a brief, general description of a robust and suitable control system 1200 in which the various aspects can be implemented. While the description above is in the general context of computer-executable instructions that can run on one or more computing systems, those skilled in the art will recognize that a novel implementation also can be realized in combination with other program modules and/or as a combination of hardware and software.

The control system 1200 for implementing various aspects includes (micro)processing unit(s) 1202 (also referred to as microprocessor(s) and processor(s)), a memory subsystem 1204 comprising a computer-readable storage medium such as a system memory and a storage subsystem 1206 (computer readable storage medium/media also include magnetic disks, optical disks, solid state drives, external memory systems, and flash memory drives), and a bus system 1208 (denoted using ellipsis . . . ). The processing unit(s) 1202 can be any of various commercially available microprocessors such as single-processor, multi-processor, single-core units and multi-core units of processing and/or storage circuits.

The control system 1200 can be employed in support of cloud access and computing services. Cloud computing services, include, but are not limited to, infrastructure as a service, platform as a service, software as a service, storage as a service, desktop as a service, data as a service, security as a service, and APIs (application program interfaces) as a service, for example.

The memory subsystem 1204 can include computer-readable storage (physical storage) medium such as a volatile (VOL) memory (e.g., random access memory (RAM), static RAM for caching, etc.) and a non-volatile memory (NON-VOL) (e.g., ROM, EPROM, EEPROM, etc.), for example. A basic input/output system (BIOS) can be stored in the non-volatile memory, and includes the basic routines that facilitate the communication of data and signals between components within the control system 900, such as during startup.

The bus system 1208 provides an interface for system components including, but not limited to, the memory subsystem 1204 to the processing unit(s) 1202, and any wire/metal track interconnectivity between all modules such as a wired/wireless transceiver subsystem 1210, operating system (OS) applications (Apps), software modules, and data components 1212, a power subsystem 1214 that provides power to all subsystems and components, and an I/O (input/output) subsystem 1216 which includes all sensors (e.g., microphone, temperature, humidity, geolocation, level, pressure, and so on) and the electronics to operate and return data therefrom. The bus system 1208 can be any of several types of commercially available bus architectures.

The power subsystem 1214 can comprise technologies such as solely a battery system (where the user replaces batteries when discharged below a minimum power level), solely a utility outlet power (e.g., the caddy system can be plugged into grid voltage such as 120 VAC to charge onboard batteries and/or operate solely on grid power), an induction technology where the user simply places the compatible electric barber tool proximate an induction plate to couple charging power into the onboard battery subsystem, or any combination of these power technologies. The power subsystem 1214 can also receive power via a portable solar power system that can connect (e.g., via a USB connector) and power the caddy and/or caddy subsystems when away from grid power, such as at the beach or lake, for example.

The control system 1200 further includes machine readable storage subsystem(s) 1206 (and storage interface(s)) for interfacing the storage subsystem(s) 1206 to the bus system 1208, and other desired components and circuits. The storage subsystem(s) 1206 (physical storage media) can include one or more of a hard disk drive (HDD), a magnetic floppy disk drive (FDD), solid state drive (SSD), flash drives, and/or optical disk storage drive (e.g., a CD-ROM drive DVD drive), for example. The storage interface(s) included as part of the storage subsystem 1206 can include commonly available interface technologies such as EIDE, ATA, SATA, and IEEE 1394, for example.

Although shown as separate blocks, one or more application programs, program data, OS, and other software modules of block 1212 can be stored in the memory subsystem 1204, a machine readable and removable memory subsystem (e.g., flash drive form factor technology), and/or the storage subsystem(s) 1206 (e.g., optical, magnetic, solid state).

The operating system, one or more application programs, other program modules, and/or program data can include items and components of the control system 1200 of FIG. 12, for example.

Generally, programs include routines, methods, data structures, other software components, etc., that perform particular tasks, functions, or implement particular abstract data types. All or portions of the operating system, applications, modules, and/or data in block 1212 can also be cached in memory such as volatile memory and/or non-volatile memory of the memory subsystem 1204, for example.

The storage subsystem 1206 and memory subsystem 1204 serve as computer readable media for volatile and non-volatile storage of data, data structures, computer-executable instructions, and so on. Such instructions, when executed by a computer or other machine, can cause the computer or other machine to perform one or more acts of a method.

Computer-executable instructions comprise, for example, instructions and data which cause a general-purpose computer, special purpose computer, or special purpose microprocessor device(s) to perform a certain function or group of functions. The computer executable instructions may be, for example, binaries, intermediate format instructions such as assembly language, or even source code. The instructions to perform the acts can be stored on one medium, or could be stored across multiple media, so that the instructions appear collectively on the one or more computer-readable storage medium/media, regardless of whether all of the instructions are on the same media.

Computer readable storage media (medium) exclude (excludes) propagated signals per se, can be accessed, and include volatile and non-volatile internal and/or external media that is removable and/or non-removable. The various types of storage media accommodate the storage of data in any suitable digital format. It should be appreciated by those skilled in the art that other types of computer readable medium can be employed such as zip drives, solid state drives, magnetic tape, flash memory cards, flash drives, cartridges, and the like, for storing computer executable instructions for performing the novel methods and processes of the disclosed architecture.

A user can interact with the programs and data using external user input devices as part of the I/O subsystem 1216 such as a keyboard and a mouse, as well as by voice commands facilitated by speech and image recognition. Other external user input devices (sensors) can include a microphone, an IR (infrared) remote control, a joystick, a game pad, camera recognition systems, a stylus pen, touch screen, gesture systems (e.g., eye movement, body poses such as relate to hand(s), finger(s), arm(s), head, etc.), and the like. The user can interact with the programs and data using user input devices such a touchpad, microphone, keyboard, etc., where desired, for example.

These and other input devices are connected to the processing unit(s) 1202 through input/output (I/O) subsystem 1216 via the bus system 1208, but can be connected by other interfaces such as a parallel port, IEEE 1394 serial port, a game port, a USB port, an IR interface, short-range wireless (e.g., Bluetooth) and other personal area network (PAN) technologies, etc. The I/O subsystem 1216 also facilitates the use of output peripherals such as printers, audio devices, camera devices, and so on, such as a sound card and/or onboard audio processing capability.

The I/O subsystem 1216 can comprise one or more graphics interface(s) (also commonly referred to as a graphics processing unit (GPU)) provide graphics and video signals on a display and external display(s) (e.g., LCD, plasma) and/or onboard displays (e.g., for portable computer). The graphics interface(s) can also be manufactured as part of a system board.

The barber caddy system 100 can operate in a networked environment (e.g., IP-based) using logical connections via the wired/wireless transceiver communications subsystem 1210 to one or more networks and/or other devices or computers. The other computers can include workstations, servers, routers, personal computers, microprocessor-based entertainment appliances, peer devices or other common network nodes, and typically include many or all of the elements described relative to the caddy system. The logical connections can include wired/wireless connectivity to a local area network (LAN), a wide area network (WAN), hotspot, and so on. LAN and WAN networking environments are commonplace in offices and companies and facilitate enterprise-wide computer networks, such as intranets, mesh networks and mesh nodes, all of which may connect to a global communications network such as the Internet 1204.

When used in a networking environment the caddy system can connect to the network via a wired/wireless transceiver communication subsystem 1210 (e.g., a network interface adapter, onboard transceiver subsystem, etc.) to communicate with wired/wireless networks, wired/wireless printers, wired/wireless input devices, and so on. The transceiver subsystem 1210 of the caddy system can include a modem or other means for establishing communications over the network.

In a networked environment, programs and data relative to the caddy system can be stored in the remote memory/storage device, as is associated with a distributed system. It will be appreciated that the network connections shown are exemplary and other means of establishing a communications link between the computers can be used.

The caddy system 100 can be made operable to communicate with wired/wireless devices or entities using the radio technologies such as the IEEE 802.xx family of standards, such as wireless devices operatively disposed in wireless communication (e.g., IEEE 802.11 over-the-air modulation techniques) with, for example, a printer, scanner, desktop and/or portable computer, personal digital assistant (PDA), communications satellite, any piece of equipment or location associated with a wirelessly detectable tag (e.g., a kiosk, news stand, restroom), telephones, cell phones, smart phones and smart devices (e.g., smart TVs), for example. This includes at least Wi-Fi™ (used to certify the interoperability of wireless computer networking devices) for hotspots, WiMax, and Bluetooth™ wireless technologies. Thus, the communications can be a predefined structure as with a conventional network or simply an ad hoc communication between at least two devices. Wi-Fi networks use radio technologies called IEEE 802.11x (a, b, g, etc.) to provide secure, reliable, fast wireless connectivity. A Wi-Fi network can be used to connect computers to each other, to the Internet, and to wire networks (which use IEEE 802.3-related technology and functions).

What has been described above includes examples of the disclosed architecture. It is, of course, not possible to describe every conceivable combination of components and/or methodologies, but one of ordinary skill in the art may recognize that many further combinations and permutations are possible. Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A caddy system for grooming tools, the caddy system comprising:

a housing for receiving a grooming tool related to at least one of giving a haircut or a shave;

multiple stations constructed into the housing and into which a station the grooming tool can be placed; and a flushing system for at least one of forcing a fluid into contact with the grooming tool while the grooming tool rests in the station.

2. The caddy system of claim 1, wherein the station further comprises a slot which enables cord management when multiple tools are placed in the caddy system.

3. The caddy system of claim 1, further comprising an interior sloped surface having an upper edge, and a lower edge that forms a sloped drain.

4. The caddy system of claim 3, further comprising a mesh drain overlay which lies over the drain and catches larger material flushed from the grooming tool during a flushing process.

5. The caddy system of claim 3, further comprising a drain plug in the housing that facilitates removal of the fluid from the housing.

6. The caddy system of claim 1, the flushing system further comprises a pumping system that pumps and recycles the fluid into contact with the grooming tool.

7. The caddy system of claim 1, wherein the fluid is at least one of a cleaning fluid for flushing particulates from the tool or a sanitization fluid for disinfecting the grooming tool.

8. The caddy system of claim 1, further comprising an individual mat for each of the stations and on which mat the corresponding grooming tool rests.

9. The caddy system of claim 1, further comprising a nozzle system, the nozzle system comprising jet nozzles that enable pressurized spray of the fluid onto a head of a grooming tool during a flushing process.

10. The caddy system of claim 1, further comprising a clip-on head guard which retains sanitizing fluid in a sanitizing material of the guard while the guard is captured on a razor head of a grooming tool.

11. A caddy system for grooming tools, the caddy system comprising:

a rectangular housing into which are constructed multiple stations for receiving grooming tools related to at least cutting hair;

an interior sloped surface constructed within the housing and having an upper edge and a lower edge, the lower edge forms a sloped drain which collects fluid flushed over a part of each grooming tool placed into a station; and a flushing system mounted internal to the housing for directing a fluid into contact with the grooming tool while the grooming tool rests in a corresponding station.

12. The caddy system of claim 11, wherein each of the multiple stations further comprises a slot constructed in a side of the housing which enables cord management when multiple tools are placed in the caddy system.

13. The caddy system of claim 11, further comprising a replaceable mat which rests on an upper surface of the sloped surface, and upon which can be placed a grooming tool.

14. The caddy system of claim 11, wherein the fluid has a disinfecting property which sanitizes a part of the grooming tool.

15. The caddy system of claim 11, further comprising a storage area embodied in the housing in which grooming tools can be placed.

16. The caddy system of claim 11, further comprising a nozzle system, the nozzle system comprising jet nozzles that enable pressurized spray of the fluid onto a head of a grooming tool during a flushing process.

17. A caddy system for grooming tools, the caddy system comprising:

a rectangular housing into which are constructed multiple stations for receiving grooming tools related to at least cutting hair, wherein each of the multiple stations further comprises a slot constructed in a side of the housing which enables cord management when multiple tools are placed in the caddy system;

an interior sloped surface constructed within the housing and having an upper edge and a lower edge, the lower edge forms a sloped drain which collects fluid flushed over a part of each grooming tool placed into a station;

a replaceable material which rests on an upper surface of the sloped surface, and upon which can be placed a grooming tool; and a flushing system mounted internal to the housing for directing a fluid into contact with the grooming tool while the grooming tool rests in a corresponding station.

18. The caddy system of claim 17, wherein the fluid has at least one of a disinfecting property which disinfects a part of the grooming tool or a lubricating property which to lubricates moving parts of the grooming tool.

19. The caddy system of claim 17, wherein the flushing system includes a nozzle system, the nozzle system comprising jet nozzles that enable pressurized spray of the fluid onto a portion of a grooming tool during a flushing process.

20. The caddy system of claim 19, wherein the jet nozzles can be adjusted to disperse the fluid over a predetermined area of the grooming tool.

* * * * *